United States Patent [19]

Rudolf et al.

[11] Patent Number: 5,058,909

[45] Date of Patent: Oct. 22, 1991

[54] ADAPTER FOR ATTACHMENT OF A SUPPLEMENTARY TOOL

[75] Inventors: Boris E. Rudolf; Walter Blutharsch, both of Stuttgart, Fed. Rep. of Germany

[73] Assignee: C. & E. Fein GmbH & Co., Fed. Rep. of Germany

[21] Appl. No.: 470,120

[22] Filed: Jan. 24, 1990

[30] Foreign Application Priority Data

Feb. 1, 1989 [DE] Fed. Rep. of Germany ..... 3902874

[51] Int. Cl.[5] ..... B24B 45/00; B24B 23/02

[52] U.S. Cl. ..... 279/8; 51/168; 51/170 T; 83/666

[58] Field of Search ..... 83/666, 700; 51/168, 51/170 T; 403/259, 261, 258, 256; 279/7, 8, 1 W; 173/163

[56] References Cited

U.S. PATENT DOCUMENTS

| | | | |
|---|---|---|---|
| 4,597,227 | 7/1986 | Gentischer et al. | 51/168 |
| 4,779,382 | 10/1988 | Rudolf et al. | 51/168 |
| 4,834,596 | 5/1989 | Hollifield et al. | 279/7 X |
| 4,941,292 | 7/1990 | Rudolf et al. | 51/168 |
| 4,989,374 | 2/1991 | Rudolf et al. | 83/666 X |

FOREIGN PATENT DOCUMENTS 0152564 8/1985 European Pat. Off. .

*Primary Examiner*—Frank T. Yost
*Assistant Examiner*—Rinaldi Rada
*Attorney, Agent, or Firm*—Barry R. Lipsitz

[57] ABSTRACT

An adapter for a grinding tool suited for standard attachment to a grinding machine is provided. The standard attachment comprises a receiving threaded bolt and an attachment nut for securing a supplementary tool in a usual manner. The grinding machine includes a motor-driven hollow spindle, to which a counterflange is firmly connected. A bolt receiving the standard attachment at one end thereof and guided by a flange can be screwed into the hollow spindle. Spring elements are provided for pressing the bolt and thereby the flange against the counterflange of the hollow spindle, in order to secure the standard attachment to the grinding tool. The hollow spindle can be axially displaced by a manual actuating device between an assembly position, in which the adapter may be taken off or attached, and a secured position, in which the adapter is secured against rotation and against axial movement within the hollow spindle.

11 Claims, 3 Drawing Sheets

ADAPTER FOR ATTACHMENT OF A SUPPLEMENTARY TOOL

BACKGROUND OF THE INVENTION

The invention relates to an adapter for attaching of a supplementary tool suited for a standard attachment to a grinding machine, the grinding spindle thereof comprising a hollow spindle with a counterflange firmly connected thereto and a positive-connection part, and further comprising a draw spindle displaceable in the axial direction in the hollow spindle and including a receiving means for a manually fixable and releasable holding element.

Such grinding machines are known from EP-A-84114612.2. In such prior art structures, however, an adapter is not provided for a supplementary tool. Instead, a holding flange is connected to the holding element and hence the tool is clampable between a counterflange and holding flange by displacement of the draw spindle.

With such grinding machines, a problem arises in that only grinding or severing discs can and are to be clamped with the holding flange and clamping of other supplementary tools with a conventional standard attachment is, to say the least, difficult.

The object underlying the invention is, therefore, to produce an adapter with which attachment of a supplementary tool suited for a standard attachment is possible.

SUMMARY OF THE INVENTION

The object of the invention is accomplished by providing an adapter comprising a bolt carrying a holding element at one end thereof and the standard attachment at an opposite end thereof, by a flange being mounted on the bolt for adjustment in the axial direction of the bolt relative thereto from an assembly position to a secured position and vice-versa, by the flange comprising a counterpart engageable with a positive-connection part, and by the bolt inserted in the grinding spindle being secured on the grinding spindle against rotation in the direction of further fixing motion of the holding element in the receiving means by the flange located in the secured position.

The advantage of the inventive adapter is to be seen in the fact that it is insertable into the grinding spindle exactly like the holding flange, that the holding element is manually fixable and releasable in the receiving means and that final clamping of the adapter is carried out by the draw spindle being pushed in the known manner in the hollow spindle in the direction away from the counterflange and being held in this position under the action of springs. Furthermore, cooperation of the flange with the bolt in the secured position ensures that the holding element cannot carry out any additional fixing motion. After displacement of the draw spindle in the direction towards the counterflange into that position in which the adapter was also manually inserted, manual release of the adapter is possible. In this manner, the adapter can be fixed on the grinding spindle and released again by displacement of the draw spindle.

One advantageous possibility for designing the receiving means and the holding element is for these two elements to form a screw connection, with the receiving means preferably being a receiving thread and the holding element a holding pin which is screwable into the receiving thread.

In a preferred embodiment, the positive-connection counterpart is designed as a flange attachment with an external multi-sided portion which fits into an internal multi-sided portion of the positive-connection part.

Several possibilities are also conceivable for the design of the standard attachment. It has proven particularly expedient for the standard attachment to be a screw connection for a supplementary tool having an attachment recess.

Within the scope of the present invention, two embodiments have proven particularly advantageous for the adjustable attachment of the flange on the bolt. In a first embodiment, the flange comprises a threaded bore through which a threaded section of the bolt extends. The bolt carries a collar which in the secured position rests against the flange and prevents further tightening of the bolt by continued rotation. With this adjustable attachment of the flange on the bolt, the bolt has in the secured position, independently of the torques acting on the supplementary tool, no further possibility of becoming further tightened in the receiving means of the draw spindle. Therefore, after displacement of the draw spindle in the direction towards the counterflange, manual release of the holding element from the receiving means and hence manual removal of the adapter from the grinding spindle are still possible.

To simplify and render particularly expedient the assembly of an adapter with such a flange, provision is made for the threaded section to comprise a thread pitch which corresponds to a thread pitch of the screw connection formed by the receiving means and the holding element. This has the great advantage that the flange can be placed on the counterflange and the bolt merely has to be screwed in. Thus, on the one hand, the bolt moves in the flange until the collar rests against the flange itself and, on the other hand, the screw connection can be simultaneously established between the receiving means and the holding element without displacement relative to the flange.

Within the scope of this first embodiment, it has also proven particularly expedient for the collar to simultaneously act as counterflange for the supplementary tool so that the latter can be clamped with the standard attachment against the collar.

In the second embodiment of the adjustable mounting of the flange on the bolt, provision is made for the flange to be guided by positive-connection parts so as to be displaceable in the axial direction of the bolt and non-rotatable on the bolt. In this case, the non-rotatable securing of the bolt in the grinding spindle is achieved by the bolt with the holding element first being brought into engagement with the receiving means, with the flange remaining in the assembly position and thereby not engaging with the positive-connection counterpart in the positive-connection part. When the holding element is in engagement with the receiving means, the flange is brought (together with the positive-connection counterpart) into engagement with the positive-connection part of the grinding spindle by displacement of the bolt in the axial direction. This ensures that the bolt is non-rotatably held in the grinding spindle by the positive connection between grinding spindle and flange and, in turn, between flange and bolt. It is particularly advantageous for the positive-connection parts to be designed with an external multi-sided portion provided on the bolt and an internal multi-sided portion provided on the flange.

The flange can be guided in different ways. It is, however, particularly simple for the flange to be guided on the bolt by the positive-connection parts themselves.

To prevent the flange from sliding freely back and forth in the axial direction on the bolt and thereby possibly impeding assembly of the adapter, provision is made for the flange to be securable on the bolt in the assembly position by locking elements. It may also prove advantageous for the flange to be fixed on the bolt by locking elements when in the secured position.

To achieve expedient adaptation of the positive-connection parts and the positive-connection counterpart with respect to their shape, provision is made for the positive-connection parts to be adapted in their cross-sectional shape to the positive-connection counterpart. It is further advantageous for the positive-connection parts to have a cross-sectional shape which represents a reduction in size of the cross-sectional shape of the positive-connection counterpart.

BRIEF DESCRIPTION OF THE DRAWINGS

Further features and advantages of the invention are to be found in the following description and the appended drawings of two embodiments. The drawings show.

DETAILED DESCRIPTION OF THE INVENTION

Figure 1:
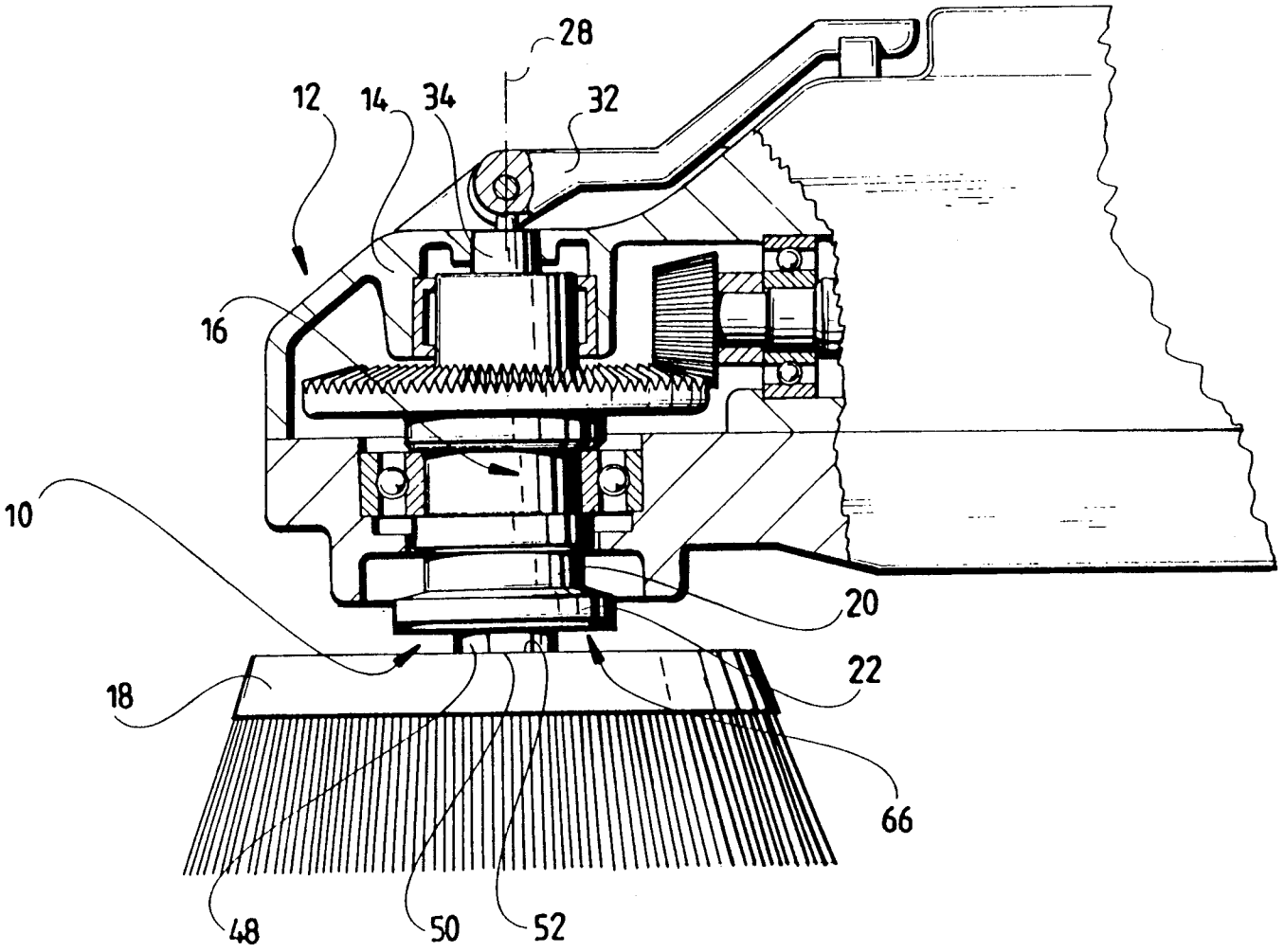
FIG. 1 a partly broken-open sectional illustration taken through a grinding machine with an adapter fixed in its grinding spindle and a supplementary tool.
Figure 2:
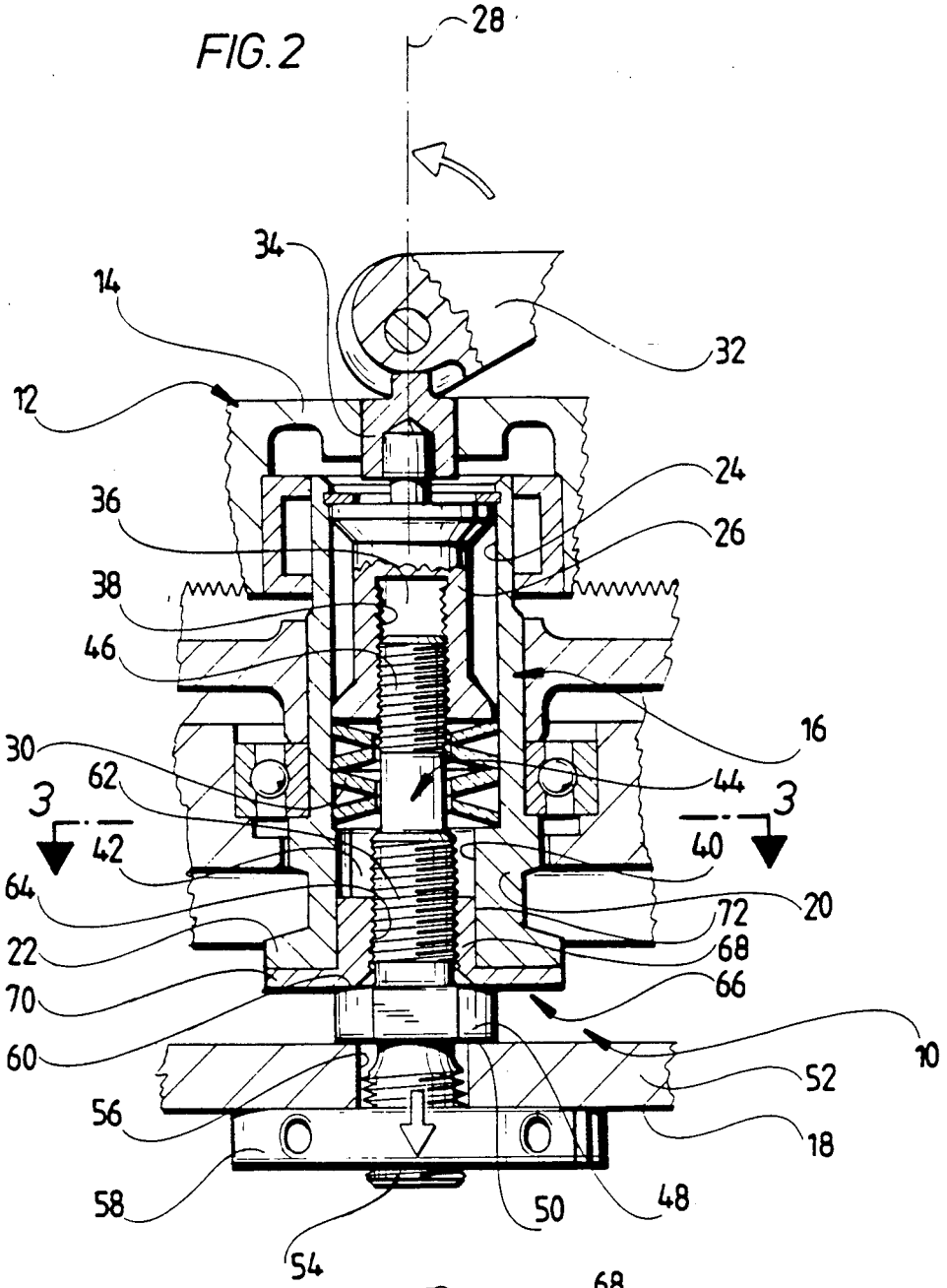
FIG. 2 a section through the grinding spindle with an adapter according to a first embodiment received therein.
Figure 3:
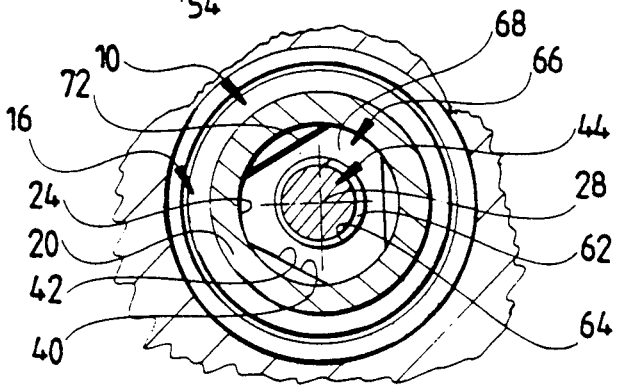
FIG. 3 a section along line 3—3 in FIG. 2.

A first embodiment of an inventive adapter designated in its entirety 10 is shown in FIG. 2 in use in a grinding machine 12, the gear head 14 of which is illustrated in a partly broken-open manner. There is arranged in the gear head 14 a grinding spindle 16 which carries the adapter 10 on which a supplementary tool 18 is held by means of a standard attachment. The grinding spindle 16 of the grinding machine 12 is driven in the conventional manner by a motor via a miter gear.

As shown in FIG. 2, the grinding spindle 16 comprises a hollow spindle 20 which is provided with a counterflange 22 at its end near the tool. In a central recess 24 of the hollow spindle 20 extending from the end near the tool into the hollow spindle 20, a draw spindle 26 is held for displacement in the direction of a longitudinal axis 28 of the grinding spindle 16 and acted upon by compression springs 30 to hold it in the direction away from the counterflange 22. By means of a manual actuating device 32 held on the gear head 14 on the side opposite the counterflange 22, the draw spindle 26 is displaceable against the force of the compression springs 30 via a thrust piece 34.

A bore 36 which is coaxial with the axis 28 and open towards the counterflange 22 is provided in the draw spindle 26. The bore 36 comprises a receiving thread 38 as the receiving means for a holding element 46.

Furthermore, in order to secure the holding element against rotation, the hollow spindle 20 is provided in the section of the central recess 24 near the tool, i.e., in the region of the counterflange 22, with an internal multi-sided portion 40 which has flat parts 42 of non-circular cross-section forming the secants of the circular cross-section.

Insertable into the conventional grinding spindle 16 is the adapter 10 according to the present invention. Adapter 10 which comprises a bolt 44 carrying at its front end a holding pin 46 which forms the holding element and can be screwed with its external thread into the receiving thread 38. Hence the bolt 44 is arranged coaxially with the axis 28 in the grinding spindle 16.

The bolt 44 is also provided with a collar 48 which carries a front face 50 arranged on the side opposite the holding pin 44 and extending perpendicularly to the axis 28 of the grinding spindle 16 and hence also of the bolt 44. The front face 50 serves as a contact surface for a carrier plate 52 of the supplementary tool 18. An attachment pin 54 of bolt 44 extends from the side of collar 48 opposite the holding pin 46. Attachment pin 54 is arranged coaxially with the holding pin 46 and extends through an attachment recess 56 in the carrier plate 52. An attachment nut 58, by means of which the carrier plate 52 can be clamped against the front face 50 of the collar 48, is screwable onto the attachment pin 54. The attachment pin 54 and the attachment nut 58 jointly form a standard attachment for the supplementary tool 18, the carrier plate 52 of which is provided with a standardized attachment recess 56.

The collar 48 is provided on the side thereof opposite the front face 50 with a contact surface 60 extending parallel to the front face 50. Between this contact surface 60 and the holding pin 46, the bolt 44 carries a threaded section 62 which has a thread pitch which is identical with a thread pitch of the holding pin 46.

This threaded section 62 extends through a threaded bore 64 of a flange designated in its entirety 66 in the region of its flange attachment 68. Integrally formed on this flange attachment 68 is a flange plate 70 which extends radially outwardly from the flange attachment 68 and is designed so as to sit on the counterflange 22. The flange attachment 68 is provided with an external multi-sided portion 72 which fits into the internal multi-sided portion 40 of hollow spindle 20. Thus, flange attachment 68 is insertable into the central recess 24 of the hollow spindle 20 where it is fixed against rotation by the flat sides of the multi-sided portion 40.

By turning the bolt 44, the flange 66 will move from a secured position in which it rests with its flange plate 70 on the contact surface 60 and also with its flange plate 70 on the counterflange 22, into an assembly position in which the collar 48 no longer rests with its contact surface 60 on the flange plate 70 but is spaced therefrom at a distance which is of such size that the holding pin 46 is no longer screwed into the receiving thread 38, as was the case in the secured position mentioned above. This means that the bolt 44 is movable relative to the flange 66 to the extent that in the secured position its holding pin 46 is in full engagement with the receiving thread 38, whereas in the assembly position the holding pin 46 is completely screwed out of the receiving thread 38. On the other hand, the threaded section 62 of bolt 44 must be of such dimensions with respect to flame 66 that in both the secured and assembly positions it remains in engagement with the threaded bore 64. In this manner, the flange 66 with the threaded bore 64 is constantly guided on the threaded section 62 of the bolt 44.

When the first embodiment of the adapter 10 according to the invention is used, it is introduced (with the flange 66 in the assembly position) into the grinding spindle 16 in such a way that the external multi-sided portion 72 of the flange attachment 68 enters into engagement with the internal multi-sided portion 40 of the central recess 24 in the hollow spindle 20 and hence secures the flange 66 in a rotationally fixed manner in the hollow spindle 20, with the flange 66 resting with its flange plate 70 on the counterflange 22. By turning the bolt 44, the latter moves on account of the threaded section 62 being in engagement with the threaded bore 64, with its holding pin 46 in the direction of the draw spindle 26 and thereby comes into engagement with the receiving thread 38. Owing to the identical pitch of the thread of the holding pin 46 and of the threaded section 62, without additional relative displacement between the flange 66 and the draw spindle 26, the bolt 44 can be screwed with the holding pin 46 into the receiving thread 38 until the collar 48 rests with the contact surface 60 on the flange plate 70 and the flange 66 is thus in its secured position.

Tight attachment of the first embodiment of the inventive adapter 10 is carried out by moving manual actuating device 32 from an adapter-non-clamping position (in which the draw spindle 26 is displaced by the manual actuating device 32 via the thrust piece 34 against the force of the compression springs 30 in the direction towards the counterflange 22) into an adapter-clamping position (in which the manual actuating device 32 no longer acts upon the thrust piece 34 and hence the draw spindle 26 is fully subjected to the force of the compression springs 30, which attempt to move the draw spindle 26 in the direction away from the counterflange 22 and hence move the bolt 44 in the same direction). In the adapter clamping position, the flange 66 containing flange plate 70 is clamped against the counterflange 22 so that the adapter 10, as a whole, is seated without play in the grinding spindle 16.

Figure 4:
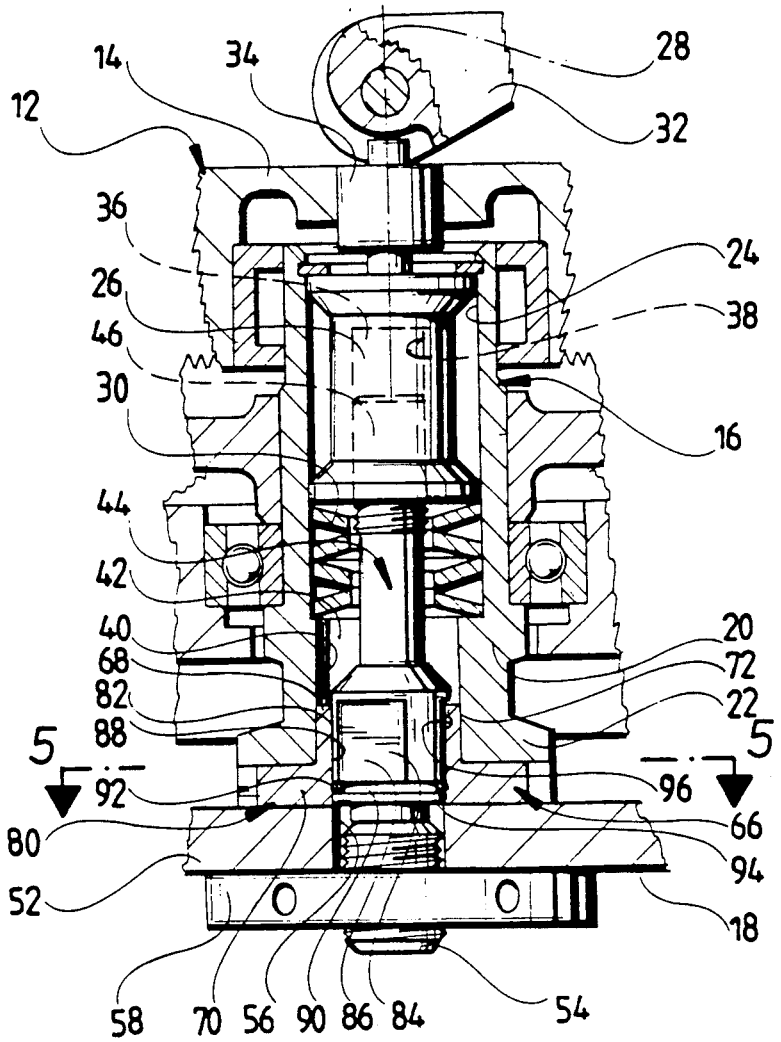
FIG. 4 a section through the grinding spindle with an adapter according to a second embodiment received therein.
Figure 5:
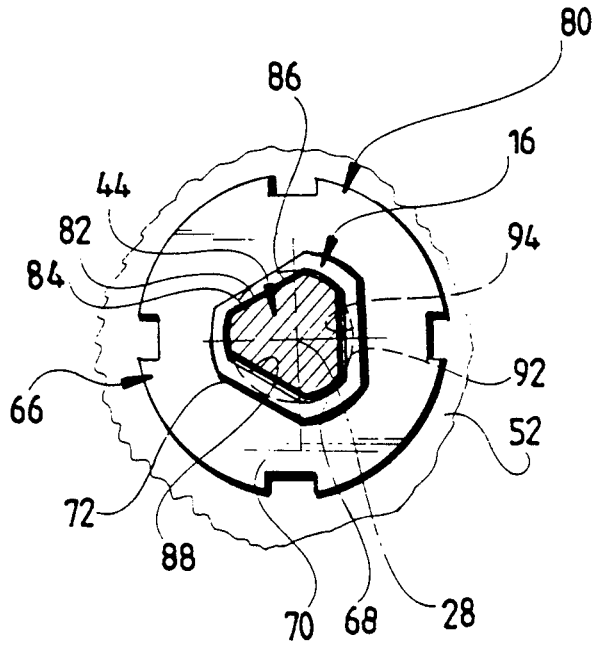
FIG. 5 a section along line 5—5 in FIG. 4.

In a second embodiment of the inventive adapter designated in its entirety 80 (FIG. 4), those parts identical with those of the first embodiment of the inventive adapter 10 have the same reference numerals and, therefore, reference is made to the statements on the first embodiment for a description of these elements. The second embodiment 80 of the inventive adapter is inserted into the grinding spindle 16 like the first embodiment 10 of the inventive adapter. Also, the supplementary tool 18 is provided with the same attachment recess 56 in its carrier plate 52.

In contrast with the first embodiment, the inventive adapter 80 according to the second embodiment carries instead of the threaded section 62 a guide section 82 with a cylindrical, external multi-sided portion 84, the flat parts 86 of which are arranged as secants of a circular arc.

The flange attachment 68 is provided with an internal multi-sided portion 88 for receiving the guide section 82 with the external multi-sided portion 84. The internal multi-sided portion 88 is preferably oriented relative to the external multi-sided portion 72 of the flange attachment 68 such that the flat parts 86 extend parallel to the flat parts 42. Thus, the internal multi-sided portion 88 has a cross-section which represents a reduction in size of the cross-section of the internal multi-sided portion 40 of the hollow spindle 20. Hence the flange attachment 68 is in the form of a hollow cylinder between the internal multi-sided portion 40 of the hollow spindle 20 and the external multi-sided portion 84 of the guide section 82.

To enable the flange 66 to be fixed in both the secured and the assembly positions relative to the bolt 44, the guide section 82 is provided with an annular groove 90 in which there lies a spring clip 92 which is resiliently engageable in the radial outward direction with annular recesses 94 and 96 in the internal multi-sided portion 40. Locking in the secured position occurs by engagement of spring clip 92 in the annular recess 94 and locking in the assembly position is provided by engagement in the annular recess 96.

In this adapter 80, the carrier plate 52 of the supplementary tool 18 does not rest on a collar but instead rests directly on the flange plate 70 which, in turn, rests on the counterflange 22.

To assemble the supplementary tool 18 with the adapter 80, the flange 66 is locked in the assembly position and the bolt 44 screwed with the holding pin 46 into the receiving thread 38. Even when the holding pin 46 is fully screwed-in, the flange 66 with its flange attachment 68 in the assembly position is not in engagement with the internal multi-sided portion 40 of the hollow spindle 20. Only by displacement of the flange 66 in the direction of the counterflange 22, when the holding pin 46 is screwed into the receiving thread 38, does the external multi-sided portion 72 of the flange attachment 68 come into engagement with the internal multi-sided portion 40 of the hollow spindle 20. This displacement is enabled by the flange attachment 68 being able to slide on the guide section 82 of the bolt 44. Once the external multi-sided portion 42 engages the internal multi-sided portion 40, the bolt 44 is non-rotatably fixed in the hollow spindle 20 and thus also in the grinding spindle 16. Hence the attachment pin 54 extending beyond the flange plate 70 can be guided through the attachment recess 56 so that the attachment nut 58 fixes the carrier plate 52 against the flange plate 70 of the flange 66. Tightening of the attachment nut 58 with a tool is not necessary. Slight turning is adequate.

Owing to the fact that during insertion of the adapter 80, the draw spindle 26 is held by the manual actuating device 32 in its position in which the tool is not clamped, by transferring the manual actuating device 32 to the position in which the tool is clamped, the draw spindle 26 can act upon the bolt 44 to move it away from the counterflange 22. As a result, the bolt 44, which is still displaceable int eh axial direction in the flange 66, moves slightly with the draw spindle 26. This causes the attachment pin to clamp the attachment nut against the carrier plate 52 of the supplementary tool 18 which, in turn, is clamped against the flange plate 70 resting against the counterflange 22 of the hollow spindle 20. Hence with the adapter 80, on transferring the draw spindle 26 from its position in which the tool is not clamped to its position in which the tool is clamped, both clamping of the adapter 80 without play and securing of the standard attachment comprising the attachment pin 54 and the attachment nut 58 are possible.

This is not the case with the first embodiment 10 of the inventive adapter where owing to the carrier plate 52 being fixed against the front face 50 of the collar 48, the attachment of the supplementary tool 18 is independent of the clamping of the adapter by the draw spindle 26.

The present disclosure relates to the subject matter disclosed in German application No. P 39 02 874.7-14 of Feb. 1, 1989, the entire specification of which is incorporated herein by reference.

What is claimed is:

1. An adapter for holding a grinding tool in a portable grinding machine of the type having:

a gear head;

a hollow spindle arranged within said gear head and being drivingly connected to a drive motor and having a central recess, defining a longitudinal axis and having an upper section and a lower section, said lower section being designed as a positive-connection part, and a counterflange situated at a lower end of said lower section;

spring means arranged within said bore and supported thereby;

a draw spindle being axially displaceable within said upper section of said hollow spindle and resting above said spring means, said draw spindle further having receiving means facing said spring means;

manual actuating means, arranged on said gear head, for axially displacing said draw spindle against a compression force of said spring means;

said adapter having a threaded pin for securing a grinding tool thereon by means of an attachment nut, said adapter further comprising:

a flange being axially displaceable within said lower section of said hollow spindle, and having a positive-connection counterpart, said positive-connection counterpart engageable with said positive-connection part of said lower section of said hollow spindle, said flange further having a flange plate facing said counterflange of said hollow spindle lower section, and having an axial opening, and a bolt having an upper portion designed as a holding element to be received within said receiving means for axially holding said bolt with respect to said draw spindle, an intermediate portion extending through said opening of said flange, and a lower portion comprising said threaded pin for receiving said grinding tool attachment nut;

wherein said draw spindle is displaceable by said manual actuating device between an assembly position for assembly or detachment of said adapter, and a secured position for securing said adapter; and wherein said flange in said secured position is pressed by said spring means against said counterflange, thereby securing said bolt against rotation and against axial movement in the direction of said receiving means.

2. An adapter as defined in claim 1, wherein said receiving means and said holding element form a screw connection.

3. An adapter as defined in claim 2, wherein said receiving means is a receiving thread and said holding element is a holding pin which can be screwed into said receiving thread.

4. An adapter as defined in claim 2, wherein said flange comprises a threaded bore through which a threaded section of said bolt extends, and wherein said bolt carries a collar which in the secured position rests against said flange and prevents further rotation of said bolt.

5. An adapter as defined in claim 4, wherein said threaded section has a thread pitch which corresponds to a thread pitch of said screw connection formed by said receiving means and said holding element.

6. An adapter as defined in claim 1, wherein said positive-connection counterpart is a flange attachment with an external multi-sided portion that fits into an internal multi-sided portion of said positive-connection part.

7. An adapter as defined in claim 1, wherein said grinding tool is provided with an attachment recess for receiving said threaded pin.

8. An adapter as defined in claim 1, wherein said flange is guided by positive-connection parts, one of them positively engaging the other part, so as to be displaceable in the axial direction of said bolt and non-rotatable on said bolt.

9. An adapter as defined in claim 8, wherein said positive-connection parts are designed with an external multi-sided portion provided on said bolt and an internal multi-sided portion provided on said flange.

10. An adapter as defined in claim 8, wherein said flange is securable on said bolt in said assembly position by locking elements.

11. An adapter as defined in claim 8, wherein said flange is fixable on said bolt in said secured position by locking elements.

* * * * *